United States Patent [19]

Claeys

[11] Patent Number: 4,928,789

[45] Date of Patent: May 29, 1990

[54] IRON WORKER'S SEAT PROTECTOR AND GRIPPING DEVICE

[76] Inventor: Shane C. Claeys, 3036 N. 97th St., Omaha, Nebr. 68134

[21] Appl. No.: 331,951

[22] Filed: Apr. 3, 1989

[51] Int. Cl.[5] ..... A62B 35/00

[52] U.S. Cl. ..... 182/3; 182/45; 182/7; 182/230

[58] Field of Search ..... 182/45, 3, 7, 108, 111, 182/230

[56] References Cited

U.S. PATENT DOCUMENTS

| | | | |
|---|---|---|---|
| 572,751 | 12/1896 | Hanna | 182/45 |
| 2,303,954 | 12/1942 | Roke | 182/3 |
| 3,137,487 | 6/1964 | Lesser | 182/3 |
| 3,212,690 | 10/1965 | Green | 182/3 |
| 3,217,833 | 11/1965 | Smith | 182/3 |
| 3,708,799 | 1/1973 | Smithdeal | 2/46 |
| 3,828,889 | 8/1974 | Rehm | 182/111 |
| 4,606,430 | 8/1986 | Roby | 182/3 |
| 4,689,829 | 9/1987 | Kaplan | 2/46 |
| 4,735,423 | 4/1988 | Foss | 280/18 |

*Primary Examiner*—Reinaldo P. Machado

*Attorney, Agent, or Firm*—Zarley, McKee, Thomte, Voorhees & Sease

[57] ABSTRACT

An iron worker's seat protector and gripping device includes an elongated flexible sheet member having an upper and lower end, and a belt secured adjacent to the upper end. The belt is secured to the worker's waist such that the sheet member hangs downwardly adjacent the worker's rump. The flexible sheet member is positioned between the worker and a beam by grasping the lower edge and pulling it upwardly and forwardly to between the legs to position the sheet member on the beam. An elongated strap is secured to the lower edge of the sheet member to assist the worker in positioning and movement of the sheet member. A chain is selectively attachable to a ring on the strap, and extends to a clamp which is selectively attached to a beam so as to hold the sheet member in the desired location on the beam.

6 Claims, 3 Drawing Sheets

IRON WORKER'S SEAT PROTECTOR AND GRIPPING DEVICE

TECHNICAL FIELD

This invention relates generally to a seat protector and gripping device for use by iron workers.

BACKGROUND OF THE INVENTION

During the erection of a steel frame structure, an iron worker must continuously move about to position and secure various components. Much of the movement about the steel frame structure is done while the worker straddles a beam. As the worker moves about, the seat, crotch, and inner thighs of the work pants are easily frayed on the beam's rough surface. Furthermore, straddling a beam for extended periods is quite uncomfortable and the clothing worn provides little insulation when the beam is hot or cold.

As the iron worker straddles a beam, the legs are used to place a constant pressure against the sides thereof so that both hands are free to work and to prevent falling from the beam. Because the legs must exert constant pressure against the sides of the beam, the worker can become fatigued, and thereby increase the risk of falling. The problem of maintaining balance is further exacerbated when working on steeply inclined surfaces. On such surfaces, the iron worker must quite often do a complicated balancing act such that at least one hand is free to work. However, in most cases, both hands are needed to do the job satisfactorily.

Any device used to protect the seat and provide a gripping surface must be comfortable when used for extended periods and at the same time not hinder any type of movement. Additionally, the device must be durable, easily manufactured and have sufficient flexibility to permit the use thereof with all types of beams.

It is therefore a primary purpose of the present invention to provide an iron worker's seat protector and gripping device which enhances safety and protects the worker's clothing.

Another object of the present invention is to provide an iron worker's seat protector and gripping device that is durable and easily manufactured.

A further object of the present invention is to provide an iron worker's seat protector and gripper device which lessens the chance of falling from a steel beam.

Yet another object of the present invention is to provide an iron worker's seat protector and gripping device which provides an increased level of comfort and protection from the heat and cold.

An additional object of the present invention is to provide an iron worker's seat protector and gripping device which permits the worker to more safely work on steeply inclined surfaces.

A related object of the present invention is to provide an iron worker's seat protector and gripping device which permits the worker to more safely utilize both hands when working.

Still a further object of the present invention is to provide a seat protector which does not hamper movement.

Another object of the present invention is to provide a gripping device which can be utilized with all types of beams.

These and other objects of the present invention will be apparent to those skilled in the art.

SUMMARY OF THE INVENTION

The iron worker's seat protector and gripping device of the present invention is formed from an elongated flexible sheet member having an upper end and a lower end. A belt is attached thereto by a loop secured adjacent to the uppermost end of the flexible sheet member. The belt is removably secured about the waist with the flexible sheet member being loosely positioned adjacent to and rearwardly from the rump and extending downwardly therefrom. In order to position the flexible sheet member between the iron worker and the beam, the worker grasps the lower edge thereof and pulls it upwardly and forwardly to position a portion of the sheet member between the legs, thereby forming a saddle-like structure. An elongated strap is secured to the lower edge of the sheet member to assist in positioning and movement of the sheet member. A ring is secured to the strap to permit a chain to be attached thereto, the chain extending to a clamp which is selectively attached to the beam to hold the sheet member in the desired position on a steeply inclined beam.

DESCRIPTION OF THE PREFERRED EMBODIMENT

Figure 1:
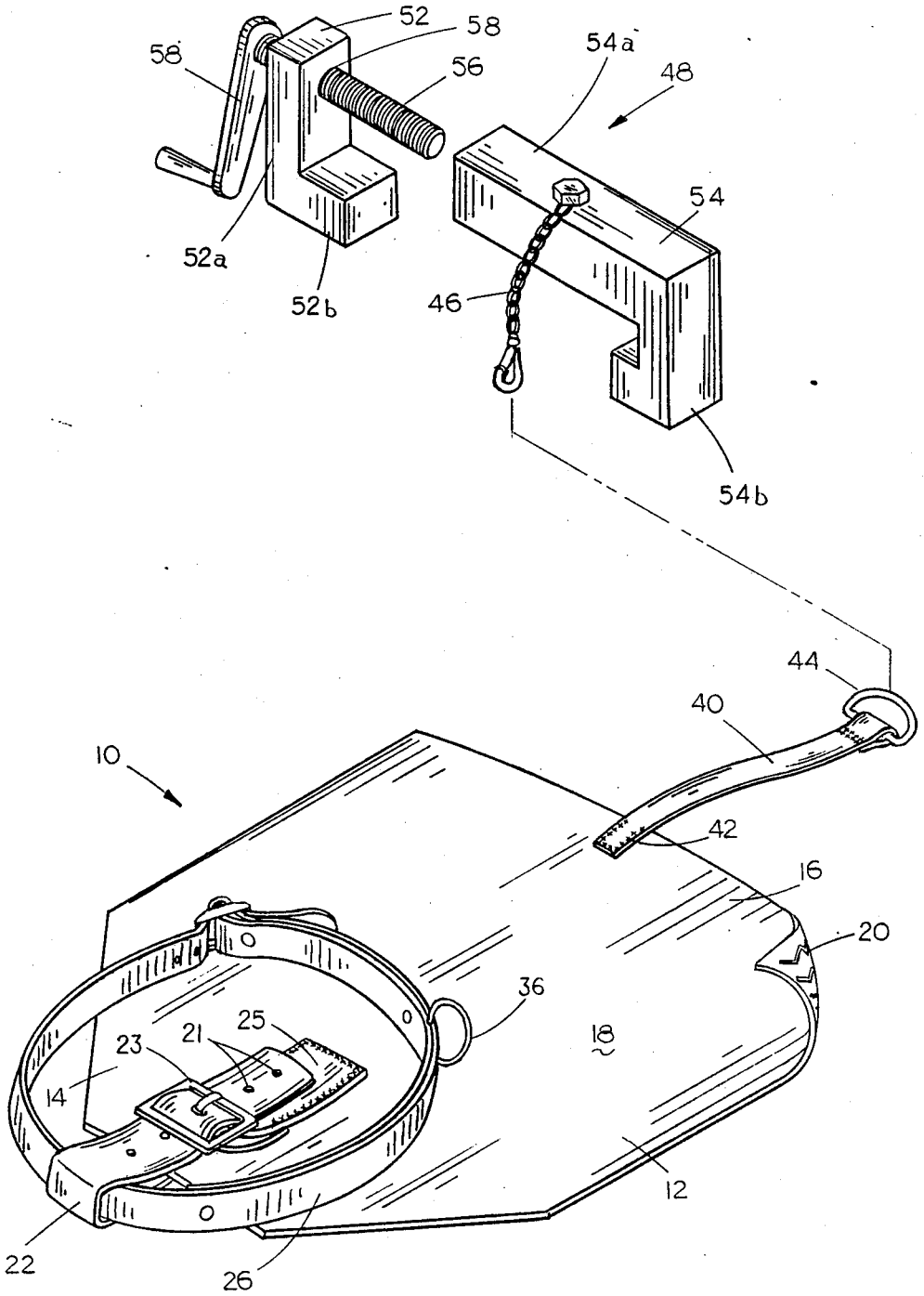
FIG. 1 is a perspective view of the present invention.

Referring now to the drawings, in which identical parts are identified by the same reference numeral, the iron workers's seat protector and gripper device of the present invention is generally identified at 10 and includes an elongated flexible sheet member 12. The flexible sheet member 12 has an upper edge 14, a lower edge 16, a smooth inner surface 18 and a textured outer surface 20 (see FIGS. 5-6). Conveyor belting has been found to exhibit all of the characteristics desirable for the flexible sheet member 12, and is the preferred material.

A loop is formed from a length of strap 22 which has one end sewn to outer surface 22 of sheet member 12 adjacent the upper edge 14. The other end of strap 22 has apertures 21 therein which co-act with a buckle 23, in a conventional fashion. Buckle 23 is fastened to one end of a tether 25 which is sewn to the forward surface 18 of sheet member 12, and will receive the free end of strap 22. A safty belt 26 is threadably inserted through loop 22 and may be secured to the worker 28 in a conventional fashion. Sheet member 12 may thereby be easily removed from safety belt 26 by unbuckling strap 22 from buckle 23.

Figure 6:
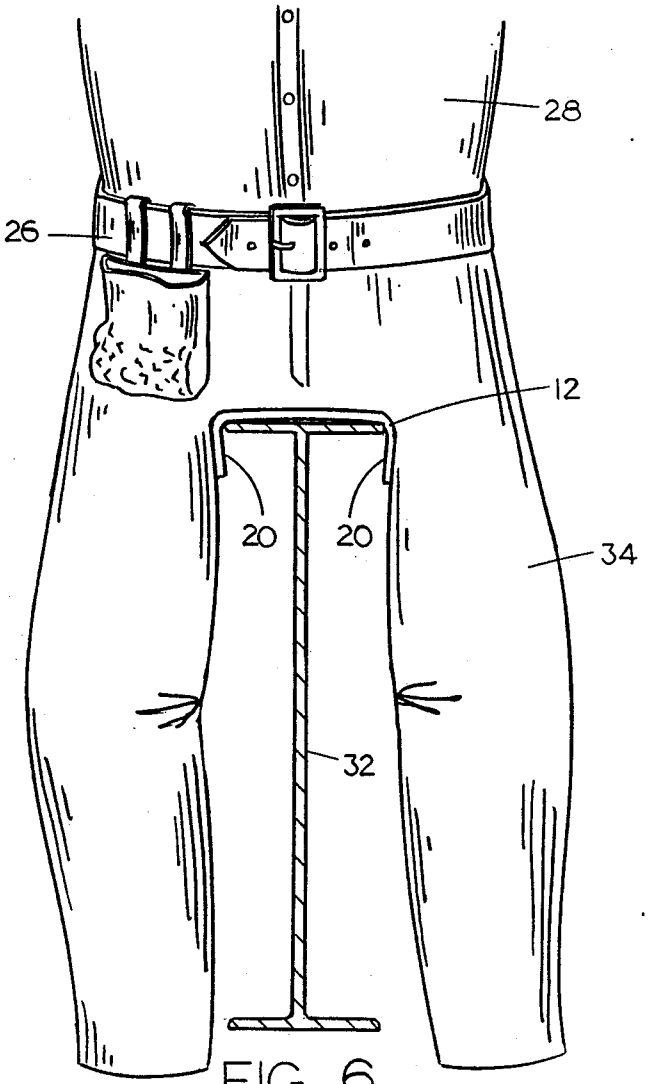
FIG. 6 is a sectional view similar of FIG. 5, with a worker holding the sheet member against a beam.

In operation, belt 26 is secured about the worker's waist with the flexible sheet member 12 being loosely positioned adjacent to the worker's rump 30. The smooth inner surface 18 is positioned against the rump 30. Flexible sheet member 12 has a length, as measured from edge 14 to edge 16, greater than the diameter of the worker's body. The width of sheet member 12 is great enough to drape over the upper flange of a conventional I-beam 32, as seen in FIGS. 5 and 6, so that the worker's legs 34 can grip the beam 32 with the sheet member 12 between legs 34 and beam 32.

To straddle a beam 32, the iron worker 28 grasps the lower edge 16 of sheet member 12 at approximately the center portion thereof and pulls sheet member 12 between his legs 34 to a position on beam 32, so that the worker can sit on the sheet member. The corners of upper edge 14 are truncated so as to prevent sheet member 12 from interfering with bolt and tool bags 31, which are hung on belt 26.

Figure 5:
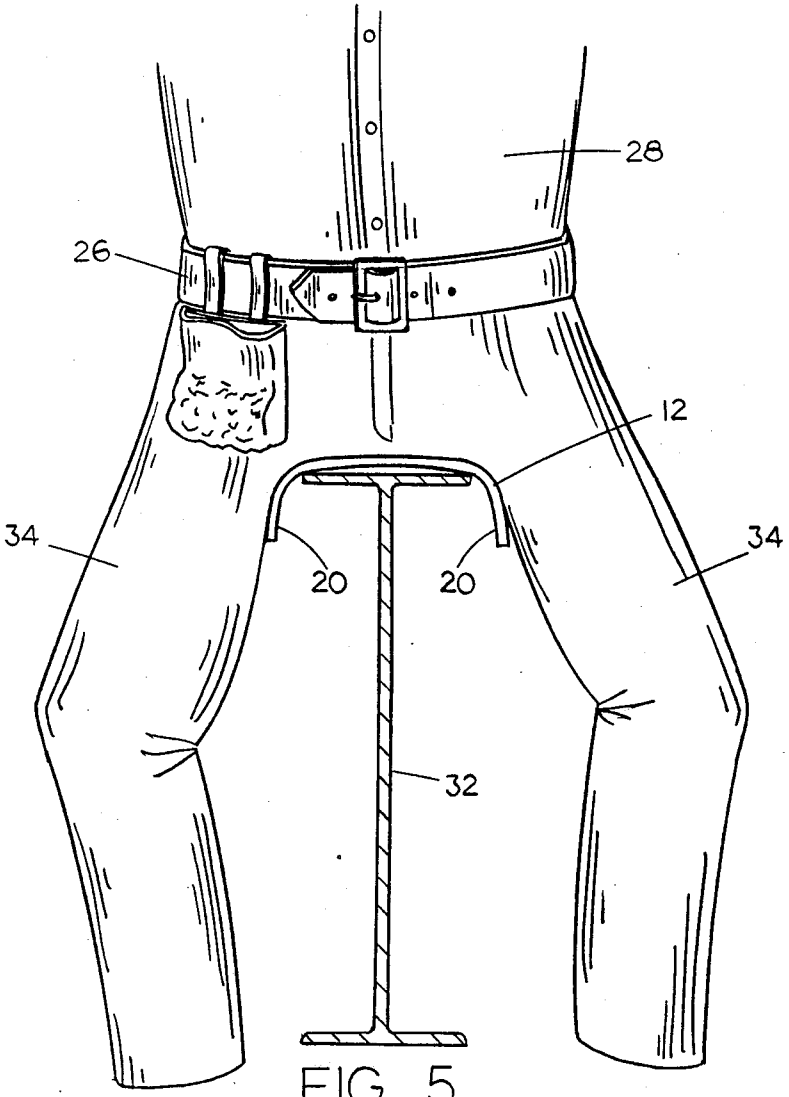
FIG. 5 is a sectional view taken at lines 5—5 in FIG. 2.

As iron worker 28 moves along beam 32, as shown in FIG. 5, the worker 28 releases leg pressure to allow the draping sides 36 and 38 of sheet member 12 to be biased outwardly from beam 32. The worker 28 then applies leg pressure as shown in FIG. 6, to bias the textured face 20 of sheet member 12 against beam 32, to firmly grip the beam. A ring 36 is fastened on safety belt 26, to which a safety chain 38 (not shown) may be attached as desired.

Because sheet member 12 is readily conformable to all types and shapes of surfaces, it provides a large amount of nonskid textured surface which is placed against the beam to prevent slipping. Further, sheet member 12 provides a layer of cushioning between the wearer and beam, the thereby insulates the worker from a beam which is hot and cold. Additionally, there is less effort required to maintain stability on a beam, because the gripping power of the textured surface of sheet member 12 allows the worker to use less leg pressure to hold on to the beam.

Figure 2:
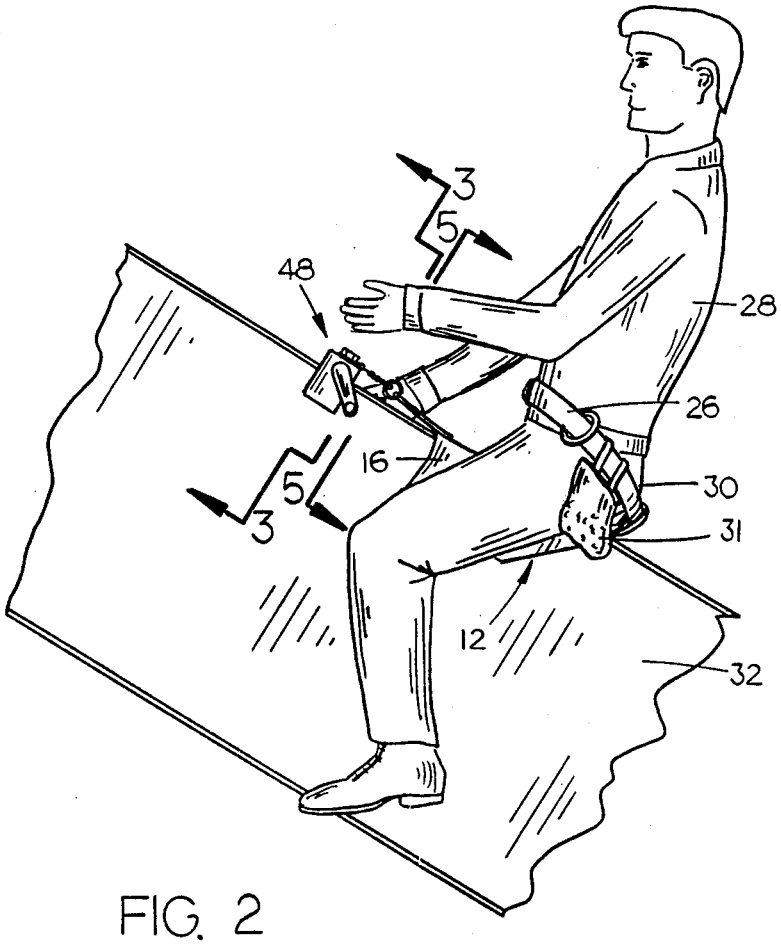
FIG. 2 is a perspective view of the invention being used by an iron worker.

In order to assist worker 28 in positioning the sheet member 12, a centrally located strap 40 is sewn at one end 42 to lower edge 16 of sheet member 12. As shown in FIG. 2, strap 40 allows worker 28 to easily pull sheet member 12 into position on beam 32.

The seat protector and gripping device 10 is of greatest value in those instances where the beam 32 is steeply sloped, as shown in FIG. 2. In such cases, it is desirable to provide an additional device for holding sheet member 12 in position on beam 32. To this end, a D-ring 44 is attached to the free end of strap 40. A chain 46 is selectively secured to D-ring 44, and extends to a clamp 48. Clamp 48 will selectively grip beam 32 so as to provide a secure point to which chain 46 is attached.

Figure 3:
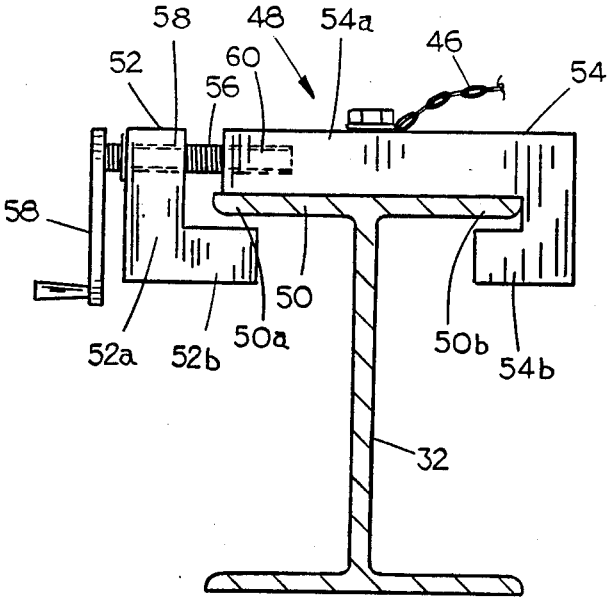
FIG. 3 is a sectional view taken at lines 3—3 in FIG. 2.
Figure 4:
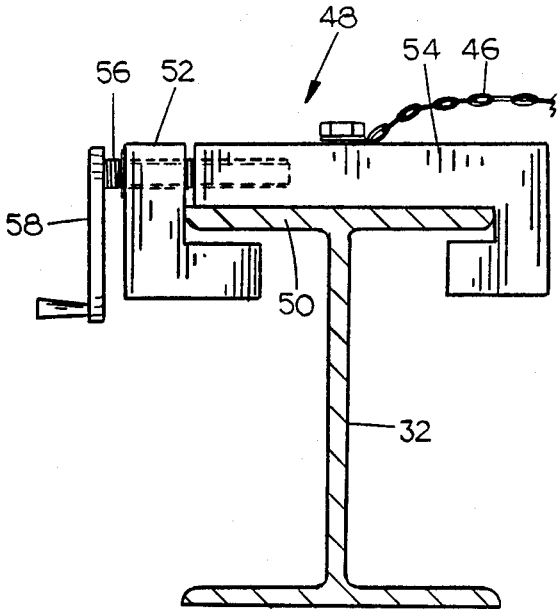
FIG. 4 is a sectional view similar to FIG. 3, with the clamp in a closed position.

As shown in FIGS. 1, 3 and 4, clamp 48 is a two-piece, c-shaped member which will grip the top flange 50 of beam 32. One leg 52 of clamp 48 is generally L-shaped, with the back **52*a* and foot 52*b* forming a lip which will grip one edge of flange 50. The remainder 54 of clamp 48 has a horizontal back portion 54*a*, and a generally J-shaped lip 54*b*, which will extend across flange 50 and grip the opposite edge 50*b*** thereof.

A threaded shaft 56 extends through an aperture 58 through back **52*a* of leg 52 and into a correspondingly threaded aperture 60 in back portion 54*a*. A handle 62 is affixed to the end of shaft 56, and is rotated to force leg 52 into contact with flange 50**.

It can thus be seen that the present invention meets all of the above-stated objectives.

I claim:

1. An iron worker's seat protector and gripping device, comprising, an elongated flexible safety belt for attachment to the user's waist, connecting strap means removably connected to said belt so as to normally hang downwardly therefrom, a substantially flat, flexible sheet member connected to said connecting strap, one surface of said sheet member having a gripping surface provided thereon, said connecting strap having a length sufficient so that said sheet member normally hangs downwardly therefrom below the user's rump and so that the user may pull the lower end thereof upwardly and forwardly to position the sheet member on a beam between the user's legs to enable the user to apply gripping pressure to the sides of the beam with his legs.

2. An iron worker's seat protector and gripping device, comprising, an elongated flexible safety belt for attachment to the iron worker's waist, a substantially flat, flexible sheet member secured to said belt so as to normally hang downwardly therefrom below and adjacent the iron worker's rump, one surface of said sheet member having a gripping surface provided thereon, said sheet member having a length sufficient so that the iron worker may pull the lower end thereof upwardly between his legs so that said sheet member may be positioned between the iron worker's legs and a beam to cushion the worker and to enable the worker to apply gripping pressure to the sides of the beam by squeezing his legs together.

3. The device of claim 2 wherein said gripping surface is tread-like.

4. The device of claim 2, further comprising a gripping strap extending downwardly from the lower edge of said sheet member, said gripping strap located generally centrally on said lower edge and having a length to permit the user to grip the strap and pull the sheet member forwardly between the user's legs so as to position it on a beam.

5. The device of claim 4, further comprising a chain means secured at one of its ends to said gripping strap, the other end of said chain means having means thereon for selective attachment to a beam to thereby connect the sheet member to the beam.

6. The device of claim 5, wherein said means for selective attachment to a beam includes operable clamping means.

* * * * *